United States Patent [19]

Sands et al.

[11] Patent Number: 4,778,443

[45] Date of Patent: Oct. 18, 1988

[54] GAS-OIL-WATER SEPARATION SYSTEM AND PROCESS

[75] Inventors: Charles D. Sands, Dickinson, Tex.; Ronald L. Schendel, Hermosa Beach, Calif.

[73] Assignee: Fluor Corporation, Irvine, Calif.

[21] Appl. No.: 30,715

[22] Filed: Mar. 25, 1987

[51] Int. Cl.[4] ..... B04B 5/10

[52] U.S. Cl. ..... 494/31; 494/36; 494/37; 55/43

[58] Field of Search ..... 494/22, 23, 27, 35, 494/36, 31, 32, 37, 42, 43, 44, 85; 208/187; 55/43

[56] References Cited

U.S. PATENT DOCUMENTS

| | | | |
|---|---|---|---|
| 2,085,537 | 6/1937 | Lyons | 494/85 |
| 2,223,999 | 12/1940 | Miller | 233/18 |
| 2,439,177 | 4/1948 | Manning | 252/347 |
| 2,572,425 | 10/1951 | Andersson | 233/11 |
| 2,585,874 | 2/1952 | Stratford | 208/187 |
| 2,862,876 | 12/1958 | Winberg | 208/187 |
| 3,107,218 | 10/1963 | Doyle | 233/15 |
| 3,113,920 | 12/1963 | Pratt | 208/33 |
| 3,208,201 | 9/1965 | Oliver | 55/166 |
| 3,273,790 | 9/1966 | Dahlberg | 494/42 |
| 3,536,254 | 10/1970 | Knight | 233/21 |
| 3,630,432 | 12/1971 | Murkes | 233/45 |
| 3,674,206 | 7/1972 | Wendt, Jr. | 233/19 A |
| 3,770,190 | 11/1973 | Doyle et al. | 233/15 |
| 3,791,575 | 2/1974 | Kartinen et al. | 233/19 A |
| 3,814,307 | 6/1974 | Hengstebeck | 233/31 |
| 3,876,135 | 4/1975 | Harvey et al. | 233/3 |
| 4,525,155 | 5/1985 | Nilsson | 494/3 |
| 4,534,860 | 8/1985 | Budzich | 210/137 |
| 4,591,433 | 5/1986 | Budzich | 210/114 |

FOREIGN PATENT DOCUMENTS

| | | | |
|---|---|---|---|
| 592425 | 2/1978 | U.S.S.R. | 55/43 |

OTHER PUBLICATIONS

G. R. Davies, et al., "Controlled Centrifugal Separation of Liquids", 1972.

General Equipment Specification, Baker Perkins Podbielniak Contactor.

Advertisements, Baker Perkins.

Perry's Chemical Engineering Handbook, 5th ed., pp. 21–29.

*Primary Examiner*—Robert W. Jenkins

*Assistant Examiner*—J. Dwight Poffenberger, Jr.

*Attorney, Agent, or Firm*—Lyon & Lyon

[57] ABSTRACT

An improved system and method of gas and petroleum production from locations such as offshore facilities in which oily water and/or wet oil or an oil/water mixture is fed to a Podbielniak type centrifugal liquid/liquid contactor for separation and purification of the oil and water phases.

19 Claims, 3 Drawing Sheets

GAS-OIL-WATER SEPARATION SYSTEM AND PROCESS

BACKGROUND OF THE INVENTION

The present invention relates to an improved system and process for separation of a mixture of oil and water from gas and separation of the mixture into its constituents in petroleum production facilities under circumstances where either the space occupied by the separation system or the weight of that system are important economic or engineering considerations or where the system is subject to motion. Offshore floating and fixed structures for the production of petroleum and gas, and production structures for use in arctic environments are examples of such circumstances.

In present gas and oil drilling and recovery practice, a gas, oil and water mixture is brought from the well and typically is sent to a high pressure, first stage, separator where gas and liquid are separated, then the liquid fraction, containing a reduced portion of gas, is sent to a medium-pressure, second stage separator where more gas is removed, and then the liquid fraction from the second stage separator, still containing some gas flows into a low-pressure, third stage separator where additional gas is withdrawn and a rough-cut separation of oil and water is made.

An alternate conventional third-stage separation may be accomplished by use of two vessels, the first having a short liquid residence time to separate gas from the liquid phase and the second having a longer liquid residence time to separate oil and water. In either case, the nominal liquid residence time for the oil/water separation is about 20 minutes, with a 10 to 30 minute range being typical. Water which is produced from either type of third stage separation system typically contains about 2000 to 5000 ppmv of free oil. By use of the term free oil we mean oil in the water phase which is not dissolved.

This water from the third stage separation then typically goes to a corrugated plate interceptor (CPI) separator which also has a residence time of about 20 minutes. Water exiting the CPI separator typically has a free oil content of approximately 100 to 200 ppmv. In some applications, this last stage of separation would be the final separation for water processing. However, in many instances where water may not be discharged to the environment with 200 ppmv of free oil, the water is then sent to a dispersed gas flotation (DGF) separator for another, final purification step. In the DGF separator a gas is used to coalesce much of the remaining free oil. Through use of the DGF separator, the water is typically purified to about 35 ppmv free oil for most applications, to about 20 ppmv free oil, in the event the water is to be released into carefully regulated environments, such as California waters and to about 10 ppmv free oil if it is to be reinjected into the producing formation so that normally installed filters will not be plugged.

In typical conventional systems the oil from the third stage separator is normally shipped "wet", that is, without further removal of water. This wet oil separated in the third stage separator typically contains approximately 3-5% by weight water and sometimes as much as 10% by weight. Water droplets in the oil are usually about 500 microns in size.

Occasionally the suspended water must be removed from the oil (dewatering of oil) prior to leaving the production site facilities for either corrosion control or to meet a particular pipeline specification. The dewatering is typically done by means of an electrostatic dehydration vessel. This is a large liquid filled vessel with internal electrodes which electrically break the surface tension between the oil and water droplets. This process usually requires the addition of chemical demulsifiers to assist in the separation and typically reduces the water content to between 0.1 and 0.5 percent by weight. When the production facility is located offshore, such electrostatic precipitators are usually located onshore because of their large size and weight. However, in situations where an offshore facility must send the oil to a pipeline in which high purity, or "spec" oil is carried, then dewatering of the oil must be accomplished offshore.

Thus, it can be seen that conventional systems make extensive use of large vessels to achieve each of the gas/oil/water separations. In these systems, the settling and electrostatic precipitator vessels are made large to provide substantial retention time and are heavy because they contain a substantial amount of liquid during normal operations. Also, such vessels lose some of their effectiveness and must be made even larger when subject to motion, as on a floating production system. Two major advantages of systems of the present invention are (i) that they will occupy considerably less space and will weigh much less than conventional systems, and (ii) that they are insensitive to motion. It is anticipated that as a result the size, weight and therefore total cost of gas and petroleum production structures may be significantly reduced.

SUMMARY OF INVENTION

The present invention arises from the application of a known device, the centrifugal countercurrent liquid/-liquid contactor (CLLC), to respond to the long-existing need for reducing the size and weight of gas and petroleum production facilities in certain particular circumstances, such as those found on offshore and arctic production structures. The device is a certrifugal countercurrent liquid/liquid contactor of the type which typically consists of cylindrical perforated plates (rotors) mounted around a shaft, all of which rotate together to achieve centrifugal forces. The Podbielniak centrifugal contactor disclosed in U.S. Pat. No. 2,670,132 and in U.S. Pat. No. 3,113,920 is a good example of such a device.

The CLLC was developed, and has been used successfully, to apply centrifugal force to "wash" or "treat" a liquid or semi-liquid substance with another immiscible liquid, but until now has not been recognized to be useful for the purposes of the present invention.

The invention is intended for use on both floating and fixed piled offshore gas and petroleum production facilities as well as onshore facilities. The invention may also be used to treat ballast water on ships and in marine terminals and on special purpose oil spill clean-up vessels. Systems using the present invention are particularly useful for oil/water separations in environments where size and weight are important. The invention has definite advantages for application on both floating and fixed offshore gas and petroleum drilling and production facilities. These advantages are derived from the high capacity of the system, its inherent insensitivity to motion, its ability to quickly react to surge conditions and its overall compactness. It lends itself for removing suspended water from the oil ("dewatering of oil"), removing suspended oil from water ("deoiling of water") and separating any mixture of oil and water into purified oil and purified water.

The proposed invention operates similarly for oil dewatering, for de-oiling of water and for separating mixtures of oil and water. The feed enters the CLLC via the shaft and is directed through the feed tubes to the required position in the rotor, which position may be varied to accommodate differences in the percentage of water in the feed. Back pressure is maintained on the oil phase outlet to hold the interface in the desired location.

Bench scale tests using a laboratory Podbielniak CLLC have been performed in accordance with the proposed invention and excellent product specifications for both the oil and water have been obtained. When wet oil containing 40% by weight water was introduced to the system the effluent oil contained 0.1 to 0.5% BS&W (bottom sediment and water) and the effluent water contained less that 30 ppmv of total oil. By use of the term total oil we mean the total of free suspended oil and dissolved oil (which, depending on the type of oil and temperature of the water phase may vary between about 10 and 15 ppmv) in the water phase. When oily water containing 3500 ppmv of oil was fed to the Podbielniak CLLC, treated water was obtained with less than 30 ppmv total oil. These results show that the system can obtain effluent qualities at least consistent with presently acceptable levels. It was also observed that the effectiveness of treating chemicals was not adversely affected by relatively short residence time.

The benefits of the invention when compared to conventional separation systems are primarily based on the following advantages:

1. High capacity and short retention time (one large CLLC can handle at least 225 $m^3/h$).
2. Compactness of system (requires much less space, has lower weight, low power consumption).
3. Higher degree of separation.
4. Lack of sensitivity to motion.
5. Quick response to surge of either phase.
6. Easily adaptable to changes in the oil/water ratios, as for example during the lifetime of gas and petroleum production facilities.
7. Significant reduction of the amount of demulsification chemicals required.

These advantages of the proposed invention are applicable to several offshore scenarios to produce presently acceptable product speficiations of oil and water effluents while reducing both the payload and required deck area requirements.

There are several types of floating and compliant tower structures used for offshore gas and petroleum drilling and production. Typically, such structures include ship shapes, semi-submersibles, barges, jack-up rigs, tension leg platforms (TLP) and, to a lesser degree, compliant towers. All of these structures are subject to motions that have a significant adverse effect on certain types of process operations and equipment. Process equipment with liquid/liquid interfaces such as liquid-phase separators (settlers), oil treaters and water treaters are particularly susceptible to motion. To compensate for motion, these types of equipment with liquid/-liquid interfaces are typically oversized, and frequently elaborate and costly internal structures are used to assist in dampening the effect of motion, resulting in an operating weight as much as 40% above that required for a design where motion is not a consideration.

In a recent study made of a conventional production system on a TLP not only were larger vessels and greater attention to vessel internal design required to control the quality of the oil, BS&W and overboard water effluents, but also, for the DGF units, recirculation of slop oil containing high concentrations of slop water was required to minimize the effects caused by motion.

In the present invention manifold savings are achieved. First, a single CLLC will achieve presently acceptable effluent quality whereas conventional systems require the use of several separator components to achieve acceptable effluent quality. Second, the space required by and the weight of the present system are to be much less than an equivalent system of conventional design. Third, the system does not need to be oversized because it is not affected by motion.

The weight savings can be as much as an order of magnitude. For example, a CPI and DGF unit designed to treat oily water at a flowrate of 225 $m^3h$ has an operating weight of about 90,000 lg. (liquid full) as compared with one Podbielniak CLLC designed for the same throughput weighing only about 11,500 kg. Because the weight of TLP's, semi-submersible and similar column stabilized type floating structures is very sensitive to topside equipment weight, a significant cost saving is obtainable. Additional savings may be obtained by utilizing the CLLC if dewatering of the separated wet oil must be accomplished. A liquid filled electrostatic oil treater for 225 $m^3/h$ of oil would typically weigh about 70,000 kg. while if an additional CCLC were needed it would weigh about 11,500 kg.

Additional savings are achieved by eliminating the need for oversizing upstream gas/liquid separation vessels. In the case of three-phase separators an average of 20 minutes retention time is given for the initial separation of the oil and water phases. When used as part of the present invention the upstream vessels need only be sized for gas/liquid separation due to the oil/water separation being accomplished in the CLLC.

A further advantage of the proposed invention is its ability to react quickly to slugging from either the water or oil phase. Due to the short retention time required, steady state is reached very quickly thus enabling slugs to be handled without affecting the quality of the effluent streams.

Over the lifetime of a petroleum production facility the water content of the crude oil production stream will increase. However, the magnitude of that increase is always uncertain. Thus, in presently known systems it has been the practice to greatly oversize the vessel still more, to anticipate and accommodate the increase. A further advantage of the present invention is that minor adjustments to the CLLC allow the system of the present invention to accommodate such increase.

In most presently known system operations, demulsifiers are used to insure an adequate separation of the oil and water. As demonstrated in the bench scale tests with the laboratory Podbielniak CLLC, no demulsifier was needed to achieve acceptable results. Thus, an anticipated further advantage of the system and process of the present invention is the elimination or reduction of the need for demulsifiers and associated storage and feeding equipment.

Even in the case of an existing petroleum production structure (where it might first appear that the advantages discussed above would not apply) the greatly reduced space required by the present invention may offer important benefits. For example, when additional wells are to be brought onstream or the production from existing wells could be increased, but the capacity of the existing conventional separating equipment is not adequate to handle the increased throughput, the present invention will permit higher throughput without added deck area by replacing present CPI, DGF, and/or oil dewatering units. Removing such present units and establishing a system in accordance with the present invention also results in additional deck space which could also be used to install new process units, such as secondary recovery systems, e.g., water flooding, gas lifting, gas injection, etc.

For the case of a new offshore installation, the use of the present invention in the oil/water separation process will reduce the overall deck space and weight requirements by as much as 10%. This will lead to similar savings in the jacket and pile weight for a typical fixed offshore structure and even greater savings for floating offshore structures and for offshore structures located in earthquake zones where the jacket structure and pile foundations must be designed to withstand significant deck mass acceleration forces. Similar advantages may be achieved in onshore structures for use in environments where it is advantageous to mount the production system on a deck or in a prefabricated structure such as the environment found at the North Slope of Alaska.

With the present invention, a pump may be used to prevent gas flashing within the CLLC and a hydrocyclone or filter may be added to remove any significant solids which may have passed through the separators. The CLLC together with those auxiliaries may also be skid mounted for the various applications of the present invention.

DETAILED DESCRIPTION OF PREFERRED EMBODIMENTS

Figure 1:
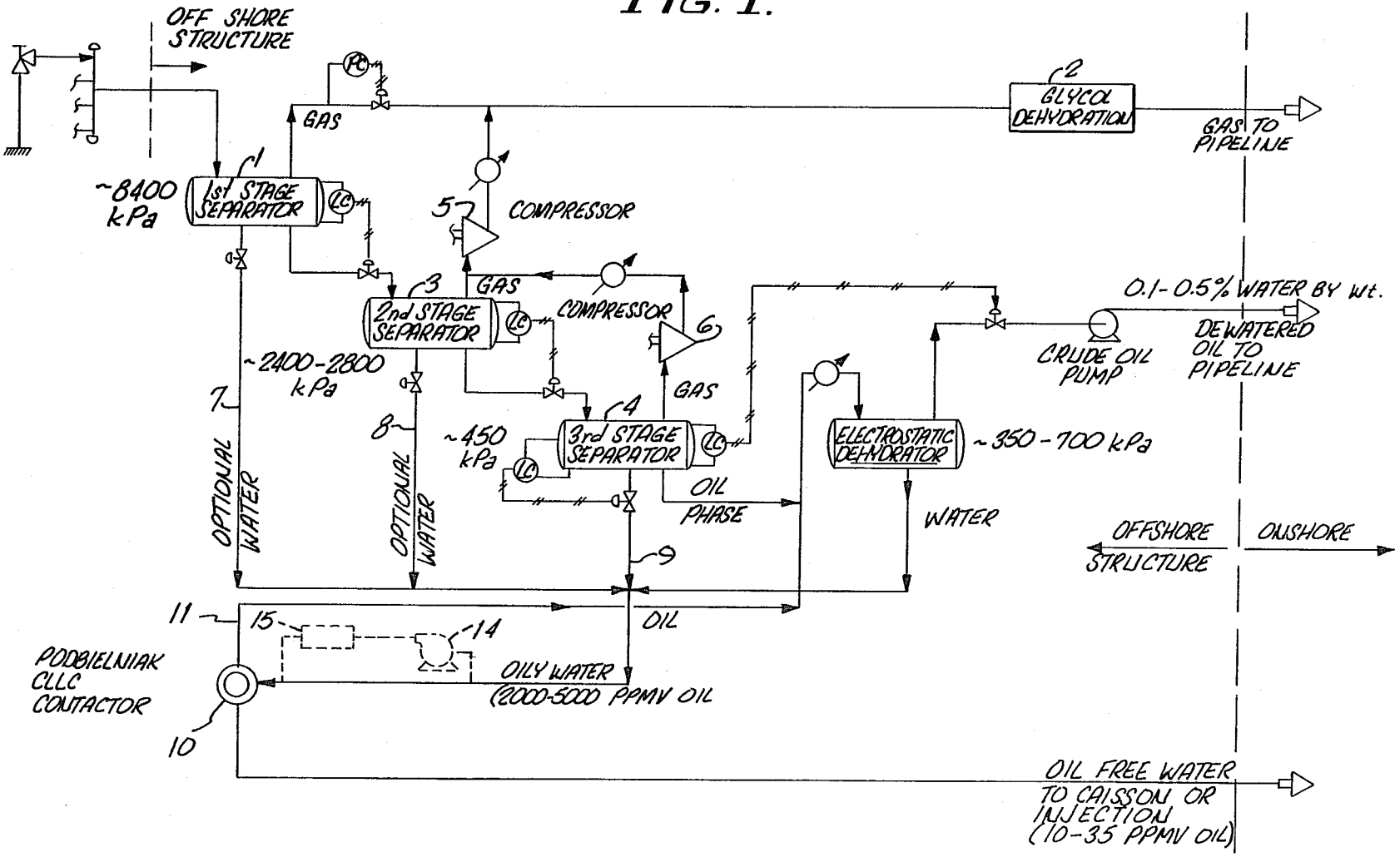
FIG. 1 is a schematic diagram of a preferred embodiment of the present invention showing only major equipment and instrumentation.

By reference to FIG. 1, a preferred embodiment of the present invention will be described:

In this embodiment, the present invention is configured to clean oily water from a gas and petroleum production facility. The gas/oil/water mixture from the well is fed into a first stage separator 1 at about 8400 kPa. Separated gas is sent to a glycol dehydration unit 2 and thereafter sent to a pipeline. A mixture of oil and water with dissolved gas from the first stage separator is fed into a second stage separator 3 at about 2400–2800 kPa. The pressures given are for a typical case only, and will vary for other locations, depth of well, etc. A mixture of oil and water with dissolved gas from the second stage separator is sent to third stage separator 4. Separated gases from the second and third stage separators 3 and 4 are compressed at compressors 5, 6 and sent to the glycol dehydrator 2 together with the separated gas from first stage separator 1. Oily water may be separated at the first and second stage separators at 7, 8. Oily water separated at the third stage separation at 9 is fed into a Podbielniak CLLC 10. A pump 14 and a hydrocyclone or filter 15 may be added, as shown in phantom lines, to prevent flashing and to remove any significant solids which may have passed through the separators. The oily water feed into the Podbielniak CLLC may also, optionally, come from oily water separated out in the first and/or second stage separators. The oily water feed mixture into the Podbielniak CLLC typically contains about 2,000 to 5,000 ppmv free oil. The oil phase effluent 11 is fed to the oil dehydrator. The single CLLC is operationally adjusted for the specific input mixture to remove the free oil from the water phase. In this separation acceptably oil-free water is produced. The produced water may then be discharged to the environment or may be reinjected into the producing formation. By comparison to conventional separating systems it is seen that this application of the present invention eliminates the need for both the CPI and DGF separators that are required in conventional systems.

Bench scale tests have been performed using a laboratory Podbielniak CLLC to purify oily water having free oil in concentrations typical of the water discharge from the third stage separator. In these tests water containing about 3500 ppmv free oil were used. Results of the tests are set forth below in Table I. As may be seen, the water purity appears to be related to flow rate and temperature. Test runs 9 and 10 included introduction of a conventional water treating chemical, such as a demulsification agent, to the feed mixture. No improvement in output water quality was observed.

TABLE I

| TEST NO. | SAMPLE FEED | % WEIGHT WATER | PPMV FREE OIL | INLET FLOW CONDITIONS | OUTLET FLOW CONDITIONS OIL | OUTLET FLOW CONDITIONS WATER | SAMPLE % BY WT. WATER IN OIL | SAMPLE % PPMV TOTAL OIL IN WATER |
|---|---|---|---|---|---|---|---|---|
| 1 | Oily Water | — | 3500 | Q = 0.037 $m^3/h$ P = 239 kpa T = 295 | Q = DROPS $m^3/h$ P = 205 k.p.a. T = 298° K. | Q = 0.077 $m^3/h$ P = 101 kpa T = 298° K. | — | 55 |
| 2 | Same as #1 | — | 3500 | Q = 0.100 $m^3/h$ P = 343 | Q = DROPS $m^3/h$ P = 377 | Q = 0.100 $m^3/h$ P = 101 | — | 28 |

TABLE I-continued

| TEST NO. | SAMPLE FEED | % WEIGHT WATER | PPMV FREE OIL | INLET FLOW CONDITIONS | OUTLET FLOW CONDITIONS OIL | OUTLET FLOW CONDITIONS WATER | SAMPLE % BY WT. WATER IN OIL | SAMPLE % PPMV TOTAL OIL IN WATER |
|---|---|---|---|---|---|---|---|---|
| | | | | kpa<br>T =<br>290° K. | kpa<br>T =<br>317° K. | kpa<br>T =<br>299° K. | | |
| 3 | Same as #1 | — | 3500 | Q =<br>0.18<br>$m^3/h$<br>P =<br>308<br>kpa<br>T =<br>301° K. | Q =<br>DROPS<br>$m^3/h$<br>P =<br>687<br>kpa<br>T =<br>355° K. | Q =<br>0.18<br>$m^3/h$<br>P =<br>101<br>kpa<br>T =<br>303° K. | — | 55 |
| 4 | Same as #1 | — | 3500 | Q =<br>0.34<br>$m^3/h$<br>P =<br>412<br>kpa<br>T =<br>305° K. | Q =<br>DROPS<br>$m^3/h$<br>P =<br>584<br>kpa<br>T =<br>345° K. | Q =<br>0.34<br>$m^3/h$<br>P =<br>116<br>kpa<br>T =<br>305° K. | — | 100 |
| 5 | Same as #1 | — | 3500 | Q =<br>0.076<br>$m^3/h$<br>P =<br>343<br>kpa<br>T =<br>309° K. | Q =<br>DROPS<br>$m^3/h$<br>P =<br>550<br>kpa<br>T =<br>335° K. | Q =<br>0.076<br>$m^3/h$<br>P =<br>101<br>kpa<br>T =<br>311° K. | — | 28 |
| 6 | Same as #1 With Heat Added | — | 3500 | Q =<br>0.072<br>$m^3/h$<br>P =<br>116<br>kpa<br>T =<br>328° K. | Q =<br>DROPS<br>$m^3/h$<br>P =<br>515<br>kpa<br>T =<br>334° K. | Q =<br>0.072<br>$m^3/h$<br>P =<br>101<br>kpa<br>T =<br>326° K. | — | 10 |
| 7 | Same as #6 | — | 3200 | Q =<br>0.170<br>$m^3/h$<br>P =<br>308<br>kpa<br>T =<br>330° K. | Q =<br>DROPS<br>$m^3/h$<br>P =<br>550<br>kpa<br>T =<br>355° K. | Q =<br>0.170<br>$m^3/h$<br>P =<br>136<br>kpa<br>T =<br>330° K. | — | 25 |
| 8 | Same as #6 | — | 3200 | Q =<br>0.470<br>$m^3/h$<br>P =<br>515<br>kpa<br>T =<br>331° K. | Q =<br>$m^3/h$<br>P =<br>618<br>kpa<br>T =<br>366° K. | Q =<br>0.470<br>$m^3/h$<br>P =<br>274<br>kpa<br>T =<br>331° K. | — | 55 |
| 9 | Same as #6 With Addition of Demulsifier | — | 3300 | Q =<br>0.073<br>$m^3/h$<br>P =<br>205<br>kpa | Q =<br>DROPS<br>$m^3/h$<br>P =<br>377<br>kpa | Q =<br>0.073<br>$m^3/h$<br>P =<br>101<br>kpa | — | 15 |
| 10 | Same as #9 | — | 3300 | Q =<br>0.522<br>$m^3/h$<br>P =<br>582<br>kpa<br>T =<br>329° K. | Q =<br>DROPS<br>$m^3/h$<br>P =<br>445<br>kpa<br>T =<br>361° K. | Q =<br>0.522<br>$m^3/h$<br>P =<br>307<br>kpa<br>T =<br>329° K. | — | 65 |

Figure 2:
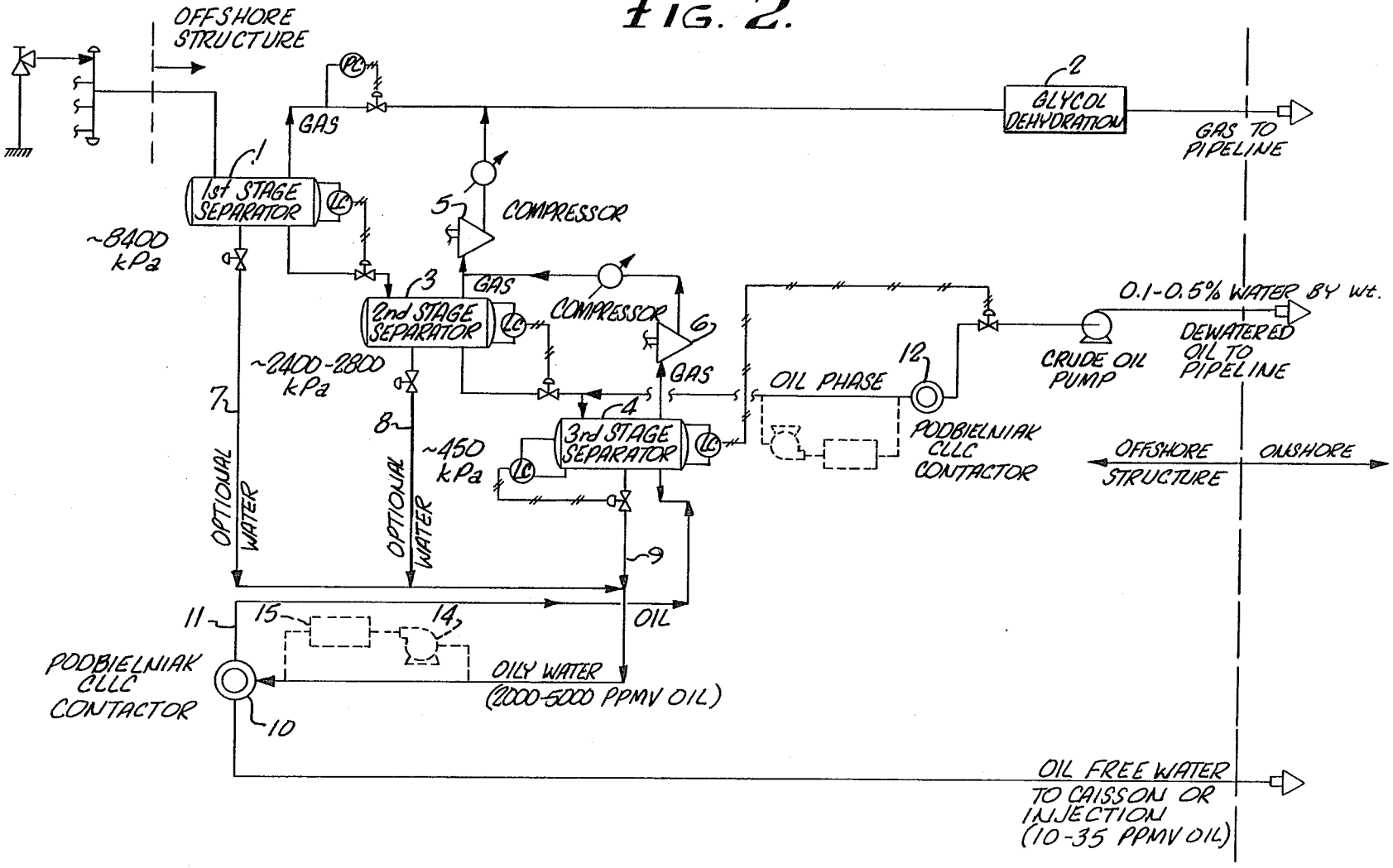
FIG. 2 is a schematic diagram of an alternate preferred embodiment of the present invention.

By reference to FIG. 2, a second preferred embodiment of the present invention is described. In an oil/water separation system a first Podbielniak CLLC is positioned and arranged to receive, as an input, water containing about 2000–5000 ppmv free oil from the third stage separator, as in the first preferred embodiment of FIG. 1. A second Podbielniak CLLC 12 is positioned and arranged to receive, as an input, wet oil from the third stage separator. The second Podbielniak CLLC 12 is operationally adjusted for the specific input mixture to dewater the oil. From this second Podbielniak CLLC 12 is produced acceptably dewatered oil. A pump 14 and hydrocyclone or filter 15, shown in phantom lines may also be used.

Bench scale tests have also been performed using a laboratory Podbielniak CLLC to purify wet oil containing about 35–40 percent water by weight. The results of these tests are tabulated in Table II below.

TABLE II

| TEST NO. | SAMPLE FEED | % WEIGHT WATER | PPMV FREE OIL | INLET FLOW CONDITIONS | OUTLET FLOW CONDITIONS OIL | OUTLET FLOW CONDITIONS WATER | SAMPLE % B4W7 WATER IN OIL | SAMPLE % PPMV TOTAL OIL IN WATER |
|---|---|---|---|---|---|---|---|---|
| 1 | Wet Oil | 40 | — | Q = 0.065 $m^3/h$ P = 722 kpa T = 297° K. | Q = 0.046 $m^3/h$ P = 618 kpa T = 314° K. | Q = 0.019 $m^3/h$ P = 116 kpa T = 305° K. | 1 | 28 |
| 2 | Wet Oil Emulsion Forming | 40 | — | Q = 0.043 $m^3/h$ P = 722 kpa T = 300° K. | Q = 0.029 $m^3/h$ P = 687 kpa T = 310° K. | Q = 0.014 $m^3/h$ P = 135 kpa T = 324° K. | 1 | 240 |
| 3 | Same as #2 With Addition of Demulsifier | 40 | — | Q = 0.040 $m^3/h$ P = 722 kpa T = 296° K. | Q = 0.026 $m^3/h$ P = 687 kpa T = 327° K. | Q = 0.014 $m^3/h$ P = 101 kpa T = 308° K. | TRACE | 88 |
| 4 | Same as #2 | 40 | — | Q = 0.098 $m^3/h$ P = 756 kpa T = 308° K. | Q = 0.062 $m^3/h$ P = 667 kpa T = 321° K. | Q = 0.036 $m^3/h$ P = 170 kpa T = 312° K. | 2 | 42 |
| 5 | Same as #3 | 40 | — | Q = 0.157 $m^3/h$ P = 825 kpa T = 311° K. | Q = 0.101 $m^3/h$ P = 687 kpa T = 319° K. | Q = 0.056 $m^3/h$ P = 170 kpa T = 313° K. | 0.5 | 74 |
| 6 | Same as #3 | 40 | — | Q = 0.264 $m^3/h$ P = 825 kpa T = 305° K. | Q = 0.160 $m^3/h$ P = 722 kpa T = 311° K. | Q = 0.104 $m^3/h$ P = 205 kpa T = 307° K. | TRACE | 28 |
| 7 | Same as #3 | 40 | — | Q = 0.551 $m^3/h$ P = 860 kpa T = 302° K. | Q = 0.335 $m^3/h$ P = 687 kpa T = 305° K. | Q = 0.216 $m^3/h$ P = 184 kpa T = 303° K. | 0.5 | 40 |
| 8 | Same as #3 Heat With Demulsifier Causing Poor Water | 35 | — | Q = 0.452 $m^3/h$ P = 894 kpa T = 327° K. | Q = 0.294 $m^3/h$ P = 687 kpa T = 327° K. | Q = 0.158 $m^3/h$ P = 170 kpa T = 326° K. | TRACE | 237 |
| 9 | Same as #8 With Additional Demulsifier | 35 | — | Q = 0.200 $m^3/h$ P = 894 kpa T = 299° K. | Q = 0.133 $m^3/h$ P = 480 kpa T = 306° K. | Q = 0.067 $m^3/h$ P = 205 kpa T = 302° K. | TRACE | 280 |
| 10 | Feed From | | | Q = | Q = | Q = | 4 | 35 |

TABLE II-continued

| TEST NO. | SAMPLE FEED | % WEIGHT WATER | PPMV FREE OIL | INLET FLOW CONDITIONS | OUTLET FLOW CONDITIONS OIL | OUTLET FLOW CONDITIONS WATER | SAMPLE % B4W7 WATER IN OIL | SAMPLE % PPMV TOTAL OIL IN WATER |
|---|---|---|---|---|---|---|---|---|
| | Test 9 Allowed to Sit Overnight | | | $m^3/h$ P = kpa T = °K. | $m^3/h$ P = kpa T = °K. | $m^3/h$ P = kpa T = °K. | | |

The results as shown in Tables I and II indicate that the present invention provides a means by which wet oil may be dewatered and a means by which oily water may be purified to acceptable levels. The fact that good results for both wet oil and for oily water were obtained in bench scale testing using a laboratory Podbielniak CLLC indicates that CPI, DGF, low pressure liquid/-liquid separator vessels and crude dehydrators such as electrostatic treaters frequently used in conventional systems may be eliminated.

Figure 3:
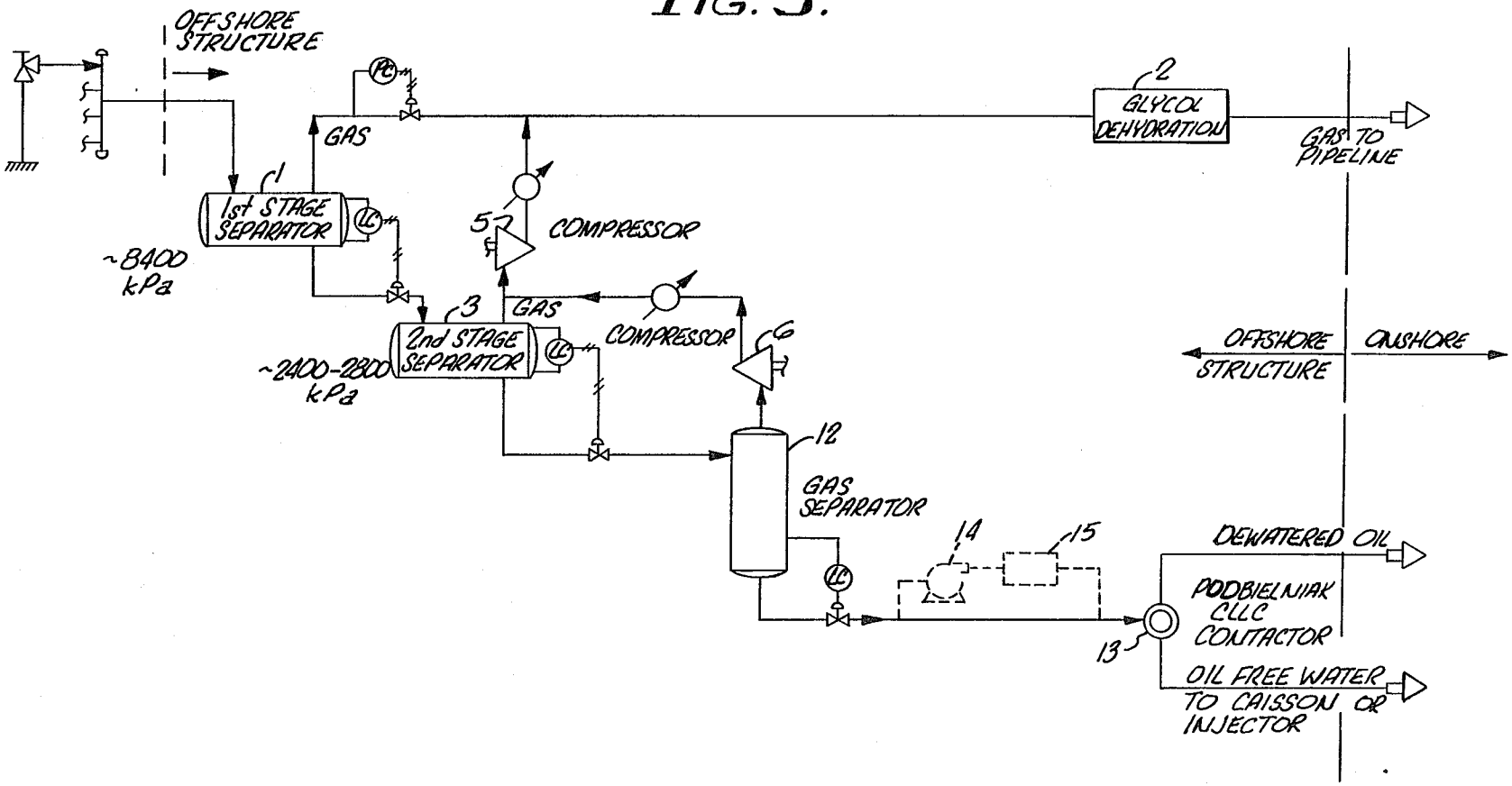
FIG. 3 is a schematic diagram of another alternate preferred embodiment of the present invention.

By reference to FIG. 3, a third preferred embodiment of the present invention is described. As in the system of FIGS. 1 and 2, first and second stage separators together with associated equipment are employed. The gas/oil/water mixture discharged from the second stage separator is fed into a small gas separator 12, from which separated gas is compressed at compressor 6. The water/oil effluent from gas separator 12 which may have any ratio of oil to water, is then fed into a single Podbielniak CLLC 13 for separation. A pump 14 and hydrocyclone or filter 15, as shown in phantom lines may also be used. As may be observed, this application eliminates the need for a large, third stage liquid/liquid separator, a CPI separator, a DGF unit and an electrostatic dehydrator by replacing all of those components with a small-gas separator and a single Podbielniak CLLC.

We claim:

1. In a gas/oil/water separation system comprising a high pressure first stage separator where gas and a first liquid are separated from a feed mixture of gas, oil and water, a medium-pressure second stage separator for receiving the first liquid which contains a reduced portion of gas and for separating additional gas from the liquid, a low-pressure third stage separator for receiving a second liquid from the second stage separator and separating additional gas from the second liquid, the improvement comprising:

a first centrifugal counter current liquid/liquid contacting device arranged and positioned to receive a water rich third liquid containing free oil from the third stage separator for removal of an effective amount of the free oil to produce purified water.

2. The system of claim 1 further comprising:

a second centrifugal countercurrent liquid/liquid contacting device arranged and positioned to process a fourth oil rich liquid containing free water from the third stage separator and to remove an effective amount of free water and to produce dewatered oil.

3. An improved gas/oil/water separation system comprising a first stage separator for removing a first portion of gas from a mixture of gas, oil and water, a second stage separator arranged to separate a second portion of gas from liquid effluent from the first stage separator, a third stag separator arranged to separate a third portion of gas from liquid effluent from the second stage separator, the improvement comprising:

a centrifugal countercurrent liquid/liquid contacting device positioned to receive a liquid effluent containing an oil/water mixture from the third stage separator and arranged to produce dewatered oil and purified water from the liquid effluent.

4. An improved gas/oil/water separation system comprising a first stage separator for removing a first portion of gas from a mixture of gas, oil and water, a second stage separator arranged to separate a second portion of gas from liquid effluent from the first stage separator, a third stage separator arranged to separate a third portion of gas from liquid effluent from the second stage separator the improvement comprising:

a high capacity centrifugal countercurrent liquid/liquid contacting device arranged and positioned to receive an oil rich liquid containing free water from the third stage separator and to remove an effective amount of free water and to produce dewatered oil from the oil rich liquid.

5. The system according to any of claims 1–4 wherein the centrifugal countercurrent liquid/liquid contacting device is a Podbielniak liquid/liquid contacting device.

6. The system according to claim 1 further comprising:

a pump positioned and arranged to receive the third liquid and to discharge the third liquid, and a device for removing particulate matter wherein both the pump and the device are arranged and positioned upstream of the inlet of the centrifugal countercurrent liquid/liquid contacting device.

7. The system of claim 2 further comprising:

a pump and a filter positioned to receive the fourth liquid from the third stage separator and to discharge the filtered fourth liquid to the second centrifugal countercurrent liquid/liquid contacting device.

8. The system of claim 3 further comprising:

a pump and a filter positioned to receive the liquid effluent from the third stage separator and to discharge the filtered liquid effluent to the centrifugal countercurrent liquid/liquid contacting device.

9. The system of claim 4 further comprising:

a pump and a filter positioned to receive the oil rich liquid from the third stage separator and to discharge the filtered oil rich liquid to the centrifugal countercurrent liquid/liquid contacting device.

10. The system according to any of claims 1–4 wherein the system is on a fixed offshore gas production facility.

11. The system according to any of claims 1–4 wherein the system is on a fixed offshore petroleum production facility.

12. The system according to any of claims 1–4 wherein the system is on a floating offshore gas production facility.

13. The system according to any of claims 1–4 wherein the system is on a floating offshore floating petroleum production facility.

14. An offshore gas, oil and water separation system comprising:

a first stage separator for receiving a first feed mixture of gas, oil and water at about 8400 kPa and for discharging a first portion of separated gas and a first portion of unseparated gas, oil and water;

a second stage separator for receiving as a feed the first portion of unseparated gas, oil and water at about 2400–2800 kPa from the first stage separator and for discharging a second portion of separated gas and a second portion of unseparated gas, oil and water;

a third stage separator for receiving as a feed the second portion of unseparated gas, oil and water from the second stage separator and for discharging a mixture of oily water containing about 2,000 to 5,000 ppmv free oil and wet oil containing up to about 40% by weight water; and a first centrifugal countercurrent liquid/liquid contacting device for receiving as a feed the oily water from the third stage separator and for producing acceptably oil-free water.

15. The system of claim 14 further comprising:

a second centrifugal countercurrent liquid/liquid contacting device for receiving as a feed the wet oil from the third stage separator and for producing acceptably water-free oil.

16. An offshore gas, oil and water separation system comprising:

a first stage separator having a liquid and gas discharge;

a second stage separator having a liquid and gas discharge; and a third stage separator having a liquid and gas discharge wherein the liquid discharge from the third stage separator is supplied to a single Podbielniak centrifugal countercurrent liquid/liquid contacting means for producing substantially purified water and substantially purified oil.

17. An improved method of recovering oil and removing water in a gas/oil/water separation process having a plurality of separations of gas from a liquid mixture of gas, oil and water and wherein effluents from the last separation of gas from the liquid include an oil rich effluent and a water rich effluent wherein the improvement comprises:

dewatering the oil rich effluent.from the last separation containing up to 50 percent by weight of free water by feeding the effluent oil to a centrifugal countercurrent liquid/liquid contacting device arranged and positioned to receive and dewater said oil rich effluent of an effective amount of the free water and producing dewatered oil.

18. An improved method of recovering water and removing oil in a gas/oil/water separation process having a plurality of separations of gas from a liquid mixture of gas, oil and water wherein effluents from the last separation of gas from the liquid include an oil rich effluent and a water rich effluent wherein the improvement comprises:

deoiling the water rich effluent from the last separation containing up to 50 percent by weight of free oil by feeding the water rich effluent to a first centrifugal countercurrent liquid/liquid contacting device arranged and positioned to receive and deoil said water rich effluent of an effective amount of the free oil and producting substantially deoiled water.

19. An improved method of recovering oil and water in a gas/oil/water separation process having a plurality of separations of gas from a liquid mixture of gas, oil and water wherein a liquid effluent containing oil and water is produced from the last separation in the plurality of separations wherein the improvement comprises:

feeding the liquid effluent from the last separation to a single certrifugal countercurrent liquid/liquid contacting device arranged and positioned to receive the liquid effluent and producing dewatered oil and purified water from the liquid effluent.

* * * * *

UNITED STATES PATENT AND TRADEMARK OFFICE

CERTIFICATE OF CORRECTION

PATENT NO. : 4,778,443

DATED : October 18, 1988

INVENTOR(S) : Charles D. Sands, and Ronald L. Schendel

It is certified that error appears in the above-identified patent and that said Letters Patent is hereby corrected as shown below:

Col. 1, line 19, delete the comma after the word "stage".

Col. 1, line 54, delete the comma after the word "oil".

Make the following corrections to Table I (pp. 5-8):

Under Test No. 1, in column 5 entitled "Inlet Flow Conditions", change "0.037" to "0.077".

Under Test No. 3, in column 7 entitled "Inlet Flow Conditions", change "290 K" to "297 K".

Under Test No. 8, in column 6 entitled "Outlet Flow Conditions Oil", add the word "DROPS".

Col. 11, line 68, change the word "stag" to "stage".

Signed and Sealed this

Twenty-ninth Day of August, 1989

*Attest:*

DONALD J. QUIGG

*Attesting Officer*

*Commissioner of Patents and Trademarks*